US005845442A

United States Patent [19]

Strehlow

[11] Patent Number: 5,845,442

[45] Date of Patent: Dec. 8, 1998

[54] HOLE COVER

[76] Inventor: J. Bradshaw Strehlow, 212 N. Russell, Ames, Iowa 50010

[21] Appl. No.: 577,811

[22] Filed: Dec. 22, 1995

[51] Int. Cl.[6] ..... E04B 1/66

[52] U.S. Cl. ..... 52/302.7; 52/19; 52/105; 52/220.1; 220/287

[58] Field of Search ..... 52/19, 20, 105, 52/220.1, 220.5, 220.8, 302.7; 220/287, 315

[56] References Cited

U.S. PATENT DOCUMENTS

| | | | |
|---|---|---|---|
| 1,117,084 | 11/1914 | Phelps | 52/220.1 X |
| 2,530,911 | 11/1950 | Schultz | 220/287 X |
| 3,699,730 | 10/1972 | Humphrey | 52/19 |
| 3,955,836 | 5/1976 | Traupe | 52/220.1 X |
| 3,969,847 | 7/1976 | Campagna et al. | 52/19 X |
| 4,472,883 | 9/1984 | Ortega | 52/105 X |
| 4,579,303 | 4/1986 | Midlik | 52/105 X |
| 5,312,202 | 5/1994 | Newton | 52/20 X |

FOREIGN PATENT DOCUMENTS

| | | | |
|---|---|---|---|
| 2647204 | 5/1977 | Germany | 52/19 |

*Primary Examiner*—Carl A. Friedmann
*Assistant Examiner*—Kevin D. Wilkens
*Attorney, Agent, or Firm*—G. Brian Pingel; Brett J. Trout

[57] ABSTRACT

A protective hole cover having a plurality of slots along which slide friction locks secured by screws. Since the slots extend radially outward, the protective hole cover may be releasably secured to holes of varying dimensions. To secure the hole cover, two of the friction locks are positioned at an appropriate distance from the center of the protective hole cover and secured by the screws extending through the slots and into the friction locks. The protective hole cover is then placed within a hole with the two friction locks contacting an interior surface of the hole. The third friction lock is then slid outward to engage the interior surface of the hole as well and the friction lock is thereafter tightened to secure the protective hole cover over the hole. When it is desired to remove the protective hole cover, one of the screws 40 is loosened and the friction lock slid inward toward the center of the protective hole cover. The protective hole cover then may be manually removed and reused on a different hole.

15 Claims, 5 Drawing Sheets

HOLE COVER

BACKGROUND OF THE INVENTION

1. Field of the Invention

The present invention relates in general to the hole cover and, more specifically, to an adjustable hole cover designed to be securely fastened over holes of various shapes and sizes.

2. Description of the Prior Art

As shown in U.S. Pat. No. 3,173,443 it is known to provide a cover which may be releasably secured over a hole by a screw or similar fastening means. A particular problem with such hole covers is that the cover must be provided with dimensions which specifically accommodate a certain size hole. Accordingly, a separate hole cover must be provided for each type of hole. Additionally, the securement means requires a lower portion to be permanently fixed within the hole requiring substantial preplanning and the loss of the lower portion when it is desired to move the hole cover to a different hole.

U.S. Pat. No. 3,911,635 shows a hollow body outlet for under-floor and under-plaster installations. The device eliminates the necessity of a second piece permanently fixed within the concrete to which the cover may be secured. Instead, the device uses a resilient material which is compressed outwardly to engage the sides of the hole. While this device eliminates the need for a permanently secured lower section, the device still must be precisely tailored to accommodate a specific hole. Additionally, if the hole is slightly irregular much of the securement ability of the device will be lost.

Although the above-described devices provide a cover for a hole, none of them provide for an adjustable mechanism for accommodating holes of various sizes. Additionally, the complexity of the devices makes their cost of construction prohibitively expensive for many applications. The difficulties encountered in the prior art discussed hereinabove, are substantially eliminated by the present invention.

SUMMARY OF THE INVENTION

The present invention provides a protective cover for a hole having an interior surface. The protective cover is provided with first means for engaging the interior surface of the hole, second means for engaging the interior surface of the hole, and a plate secured to the first engaging means. The plate is provided with a plurality of engaging means attachment points including at least a first attachment point and a second attachment point wherein the first attachment point is provided further from the center then the second attachment point. The second engaging means is secured to at least one of the plurality of attachment points.

Preferably, the plate is circular and beveled around its circumference. The plate is also preferably provided with three slots extending radially outward from the center of the plate. Preferably, three engaging means are provided and constructed of threaded bolts which pass through the slots in the plate. The threaded bolts are secured to rectangular frictional blocks in a manner which allows the plate to be placed over a hole, the bolts slid outward to engage the sides of the hole and the bolts tightened to secure the frictional engaging blocks against the plate as well as the interior sides of the hole. In this manner, the protective cover may be quickly applied to or removed from a hole without the use of complicated or expensive machinery.

DETAILED DESCRIPTION OF THE PREFERRED EMBODIMENTS

Figure 1:
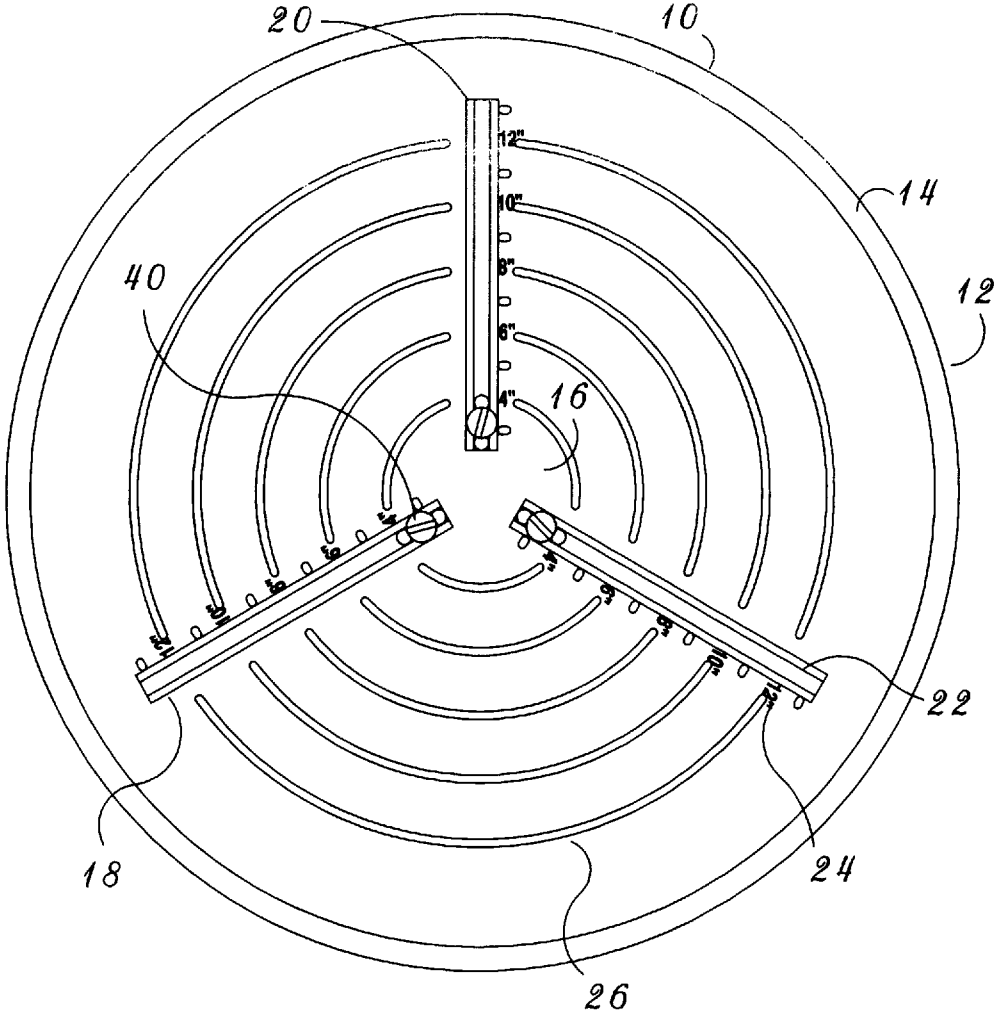
FIG. 1 is a top elevation showing the protective cover of the present invention.

With reference to the drawings, a protective hole cover is indicated generally as 10 in FIG. 1. As shown, the cover 10 is provided with a circular plate 12 having a beveled circular circumference 14. Preferably the circular plate is injection molded of a high density plastic but may, of course, be constructed of any suitably rigid material. The plate 12 is provided with a center 16 and a slot 18, a supplemental slot 20, and a second supplemental slot 22. These three radial slots 18, 20, and 22 extend between the center 16 and the beveled circular circumference 14. The slots 18, 20, and 22 are ruled and provided with numerical designations 24 which represent the size of hole to be covered. The circular plate 12 is also provided with arcuate ridges 26 between the slots 18, 20, and 22 to provide a representation of an underlying hole of a particular diameter.

Figure 6:
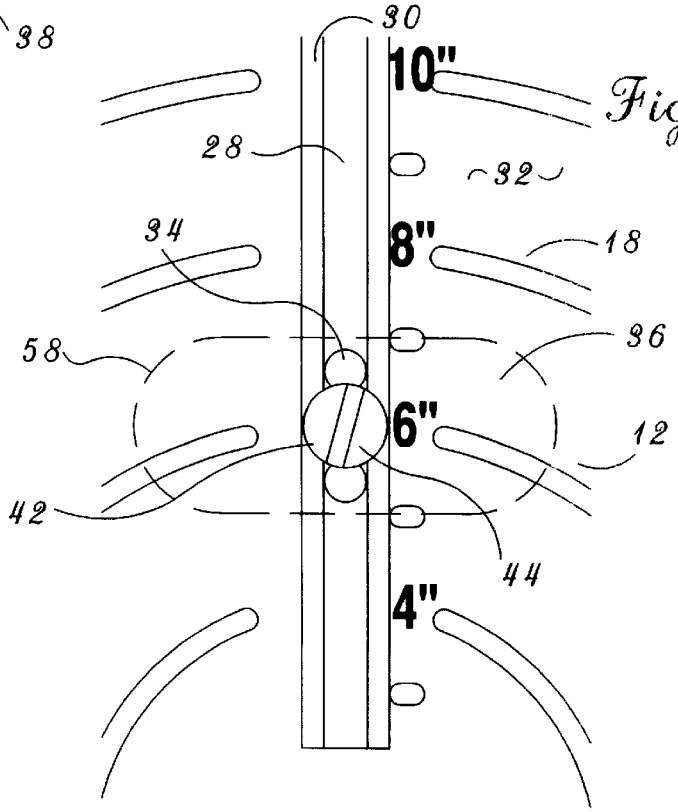
FIG. 6 is a top elevation in partial phantom showing the bolt and friction lock mechanism of the present invention.

An enlarged view of slot 18 is shown in FIG. 6. As the characteristics of all three slots 18, 20, and 22 are substantially similar, description will be limited to the single slot 18. As shown in FIG. 6, the slot 18 is provided with an opening 28 and a support rail such as a ledge 30. The ledge 30 is preferably approximately 0.5 centimeters wide and completely surrounds the opening 28. The ledge 30 is recessed approximately 2 Millimeters from a face portion 32 of the circular plate 12. Extending through the opening 28 from below the circular plate 12 are a pair of bosses 34 which are secured to a friction lock 36.

Figure 7:
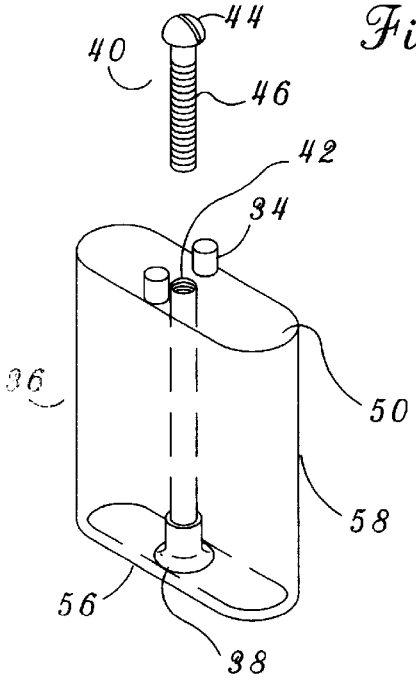
FIG. 7 is a perspective view of a friction lock of the present invention.

The friction lock 36 is provided with a hole 42 into which is molded propell nut 38 having a threaded interior. (FIG. 6). The bosses 34 are provided on either side of the hole 42 and extend through the opening 28 of the slot 18 (FIGS. 6–7). Secured into the propell nut 38 is a screw 40 which passes from above the circular plate 12 through the friction lock 36 and into the propell nut 38. The screw 40 is provided with a head 44 of a sufficient size to prevent the screw 40 from passing through the opening 28 of the slot 18. The screw 40 is also provided with a body 46 of a sufficient length to become securely fastened to the propell nut 38 of the friction lock 36. (FIGS. 6–7). The head 44 of the screw 40 is preferably of a diameter sufficient to allow the head 44 of the screw 40 to slide along the rails 30 of the slot 18. The head 44 of the screw 40 is short enough and the rails 30 deep enough so that when the screw 40 is tightened the head 44 does not extend beyond the face portion 32 of the circular plate 12 a sufficient distance to interfere with items passing over the circular plate 12.

Figure 2:
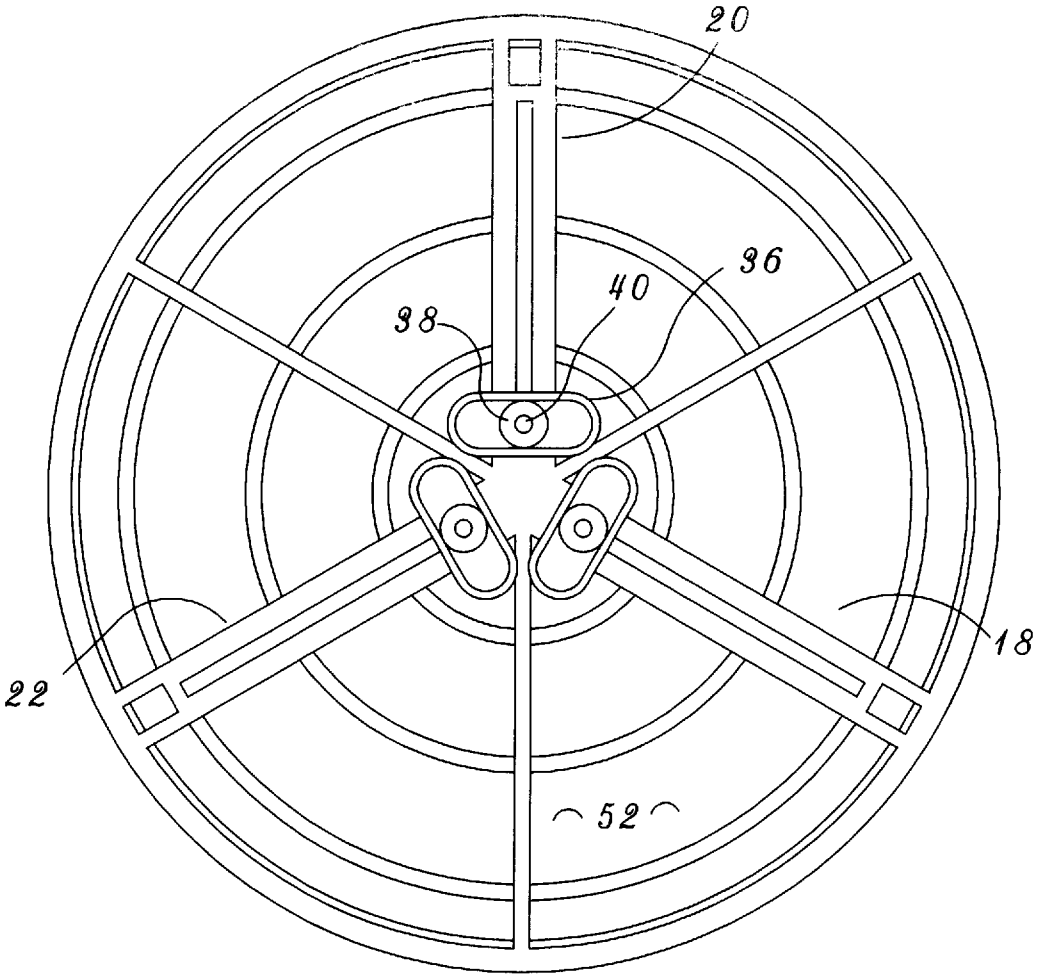
FIG. 2 is a bottom elevation of the protective cover of FIG. 1.
Figure 3:
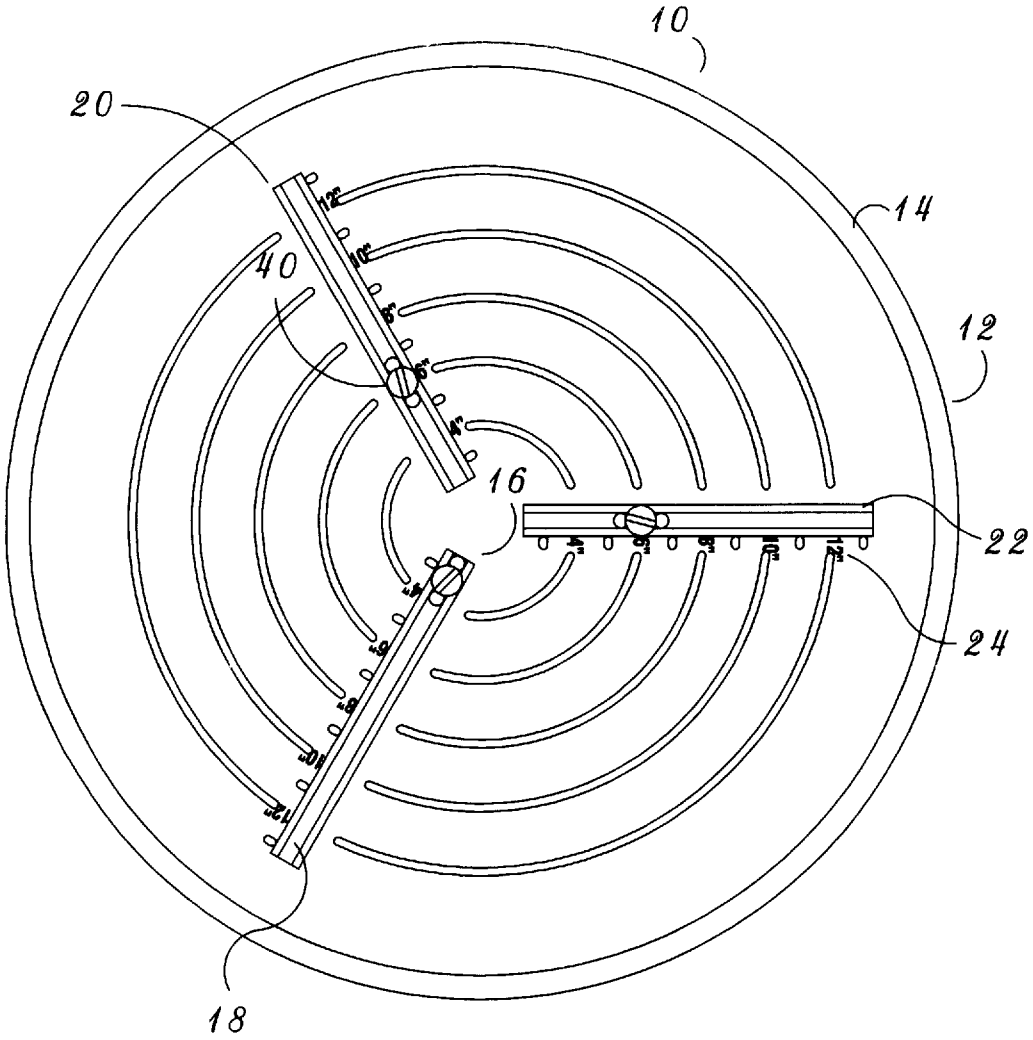
FIG. 3 is a top elevation of a protective cover of FIG. 1 with two of the three bolts secured to the plate for placement over a hole.

To operate the protective hole cover 10, the cover 10 is received in the orientation shown in FIG. 2. If it is desired to cover a hole 48 having a six inch diameter, the screws 40 provided within the second slot 20 and third slot 22 are loosened and the friction locks 36 associated therewith are positioned at the numerical designations 24 representing a hole six inches in diameter. (FIG. 3). Once the friction locks 36 have been properly positioned, the screws 40 associated with the second slot 20 and third slot 22 are tightened until top portions 50 of the friction locks 36 are firmly engaged to a bottom face 52 of the circular plate 12. (FIGS. 3 and 7).

Figure 4:
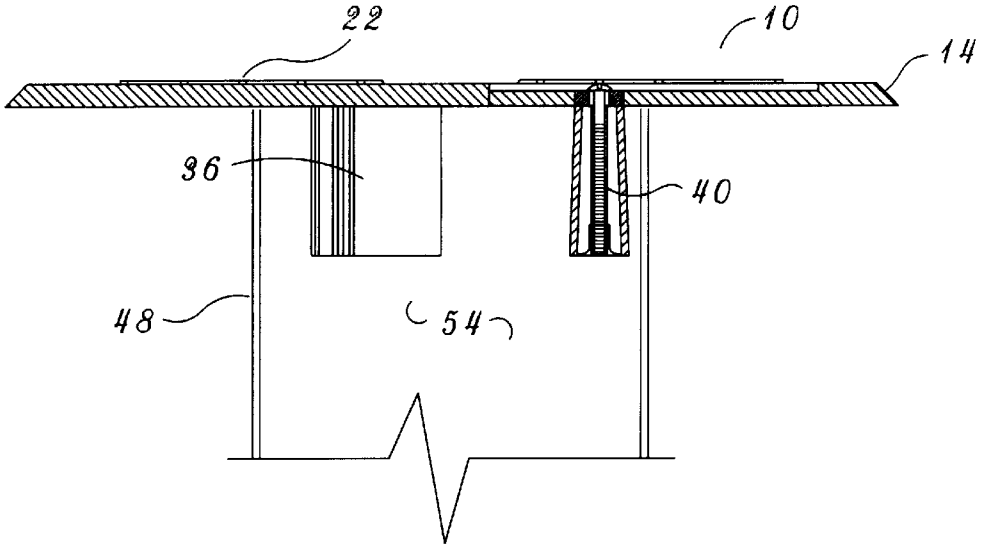
FIG. 4 is a side elevation in cross-section of the protective cover of FIG. 3 shown placed over a hole.
Figure 5:
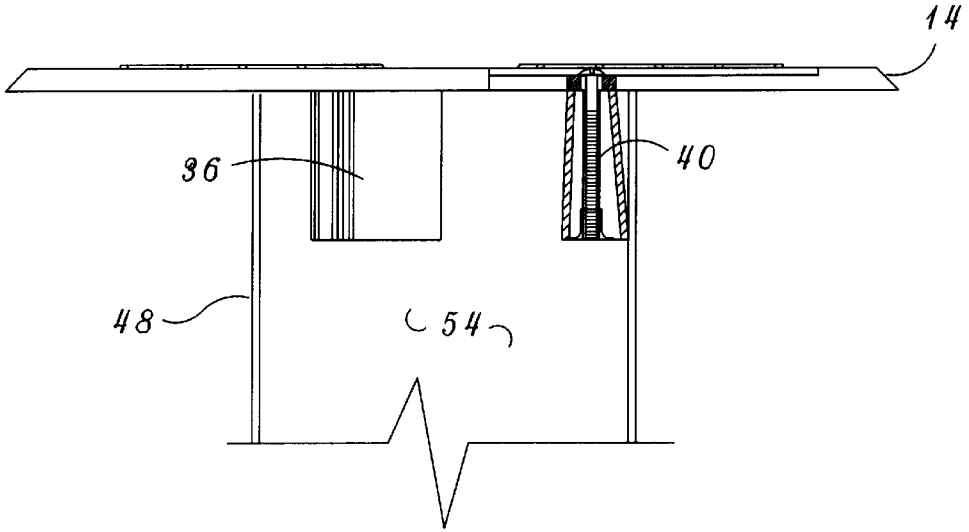
FIG. 5 is a side elevation in cross-section of the protective cover of FIG. 3 shown with the third friction lock secured against a side of FIG. 5*a* is a side elevation in cross-section of the friction lock of the present invention; the hole.

Because FIG. 4 shows a cross-section of the cover 10 dividing the cover into two equal halves, and since there are only three friction locks 36, the friction lock 36 associated with slot 18 is shown in cross-section, the friction lock 36 associated with slot 20 is not shown, and the remaining friction lock 36 associated with slot 22 is shown in three-quarters profile (FIGS. 3–4). As shown in FIG. 4, the cover 10 is positioned within the hole 48 in a manner such that the friction lock 36 associated with the third slot 22 is positioned against an interior surface 54 of the hole 48. The friction lock 36 associated with the second slot 20 is also positioned against the interior surface 54 of the hole 48 but cannot be seen in the cross-sectional view of FIG. 4. Once the two friction locks 36 associated with the second slot 20 and third slot 22 have been positioned against the interior surface 54 of the hole 48, the screw 40 associated with the first slot 18 is loosened and the screw is slid radially outward along the first slot 18 until the friction lock 36 associated with the first slot 18 comes into contact with the interior surface 54 of the hole 48. (FIG. 5). Once the friction lock 36 of the first slot 18 is thereby positioned, the screw 40 is tightened until the top portion 50 of the friction lock 36 is firmly engaged to the bottom face 52 of the circular plate 12. Once the cover 10 is secured, the beveled circular circumference 14 allows pedestrians (not shown) to travel over the cover 10 without dislodging the cover 10 from the hole 48.

Figure 5A:
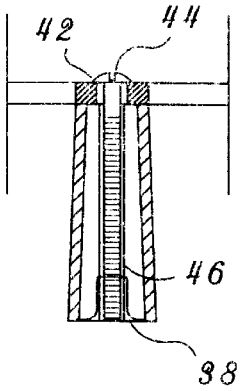

Preferably, as shown in FIG. 5*a*, the friction locks 36 are slightly angled to provide a bias of the friction locks 36 against the interior surface 54 of the hole 48. Although this angle may be of any suitable dimension, it has been found particularly advantageous to provide the friction locks with a one degree angle extending from the narrower top portion 50 to a wider bottom portion 56.

The rounded rectangular dimension of the friction locks 36 allows each friction lock 36 to contact the interior surface 54 of the hole 48 at two points, one at each corner of the friction lock 36 (FIG. 7). To prevent the friction lock 36 from moving out of alignment with the slots 18, 20, and 22, the bosses 34 extend through the slots 18, 20, and 22 and resist any torquing of the friction locks 36 caused by tightened or loosening the screws 40 (FIG. 6).

When it is desired to remove the cover 10, the screw 40 associated with the first slot 18 is loosened and the screw 40 is slid toward the center hole 16, thereby allowing the protective hole cover 10 to be manually lifted from the hole 48 and subsequently reused (FIG. 3). For holes having a different diameter, the aforementioned process is simply repeated with the screws 40 of the second slot 20 and third slot 22 being initially positioned and tightened at the appropriate position along the slots 20 and 22. The screw 40 of the first slot 18 is then slid outward and tightened to the circular plate 12 after the protective hole cover 10 has been placed within the new hole.

Although the invention has been described with respect to a preferred embodiment thereof, it is to be understood that it is not to be so limited, since changes and modifications can be made therein which are within the full intended scope of this invention defined by the appended claims. For example, it is anticipated that any number, size, and orientation of slots may be used to achieve the securement attribute of the protective hole cover 10 and that any design of friction lock may be used to accommodate various holes. It is additionally anticipated that the hole cover 10 may be used on interior or exterior walls or ceilings to prevent ingress and egress of the elements, insects, and the like.

What is claimed is:

1. A protective cover for a hole having an interior surface, said cover comprising:

(a) first means for engaging the interior surface of the hole;

(b) second means for engaging the interior surface of the hole;

(c) a plate having a center, a top, a bottom and a perimeter, said plate being provided with a slot extending radially between said center of said plate and said perimeter of said plate, said first engaging means being slidably coupled to said slot; and (d) means passing through said slot for locking said first engaging means against slidable movement relative to said bottom of said plate, wherein said locking means is accessible from said top of said plate.

2. The protective cover of claim 1, wherein said plate is circular.

3. The protective cover of claim 1, wherein said plate is provided with a beveled perimeter.

4. The protective cover of claim 1, further comprising:

(a) a supplemental slot extending radially between said center and said perimeter of said plate, said second engaging means being slidably coupled to said supplemental slot; and (b) supplemental means passing through said supplemental slot for locking said second engaging means against slidable movement relative to said bottom of said plate, wherein said supplemental locking means is accessible from said top of said plate.

5. The protective cover of claim 1, wherein said second engaging means comprises a bolt extending through said plate, said bolt having a head and a body with a friction lock secured to said body.

6. The protective cover of claim 5, wherein said friction lock is a rounded rectangular block.

7. The protective cover of claim 6, further comprising means for maintaining said rounded rectangular block in a predetermined orientation relative to said plate as said bolt slides relative to said plate.

8. The protective cover of claim 5, wherein said friction lock is provided with a first side capable of substantially preventing movement of said friction lock relative to the interior surface of the hole and a second side capable of substantially preventing movement of said friction lock relative to said plate.

9. The protective cover of claim 1, further comprising third means for engaging the interior surface of the hole.

10. The protective cover of claim 9, wherein said first engaging means, said second engaging means, and said third engaging means are located on said plate substantially equidistant from one another.

11. The protective cover of claim 9, wherein said plate is provided with a second slot and a third slot both extending radially between said center and said perimeter of said plate, said protective cover further comprising:

(a) second locking means for sliding said second engaging means relative to said plate, along said second slot, wherein said second lockable sliding means is accessible from said top of said plate; and (b) third lockable means for sliding said third engaging means along said third slot relative to said plate, wherein said third lockable sliding means is accessible from said top of said plate.

12. A protective cover for a hole having an interior surface, said cover comprising:

(a) a plate having a first slot having a length greater than its width, a second slot having a length greater than its width, and a third slot having a length greater than its width, spaced substantially equidistant from one another;

(b) a first bolt having a head and being secured through said first slot to a first friction lock;

(c) a second bolt having a head and being secured through said second slot to a second friction lock;

(d) a third bolt having a head and being secured through said third slot to a third friction lock.

13. The protective cover of claim 12, wherein said plate is provided with a beveled perimeter.

14. The protective cover of claim 12, wherein said first friction lock, said second friction lock, and said third friction lock are rounded rectangular blocks.

15. The protective cover of claim 14, further comprising means for maintaining said rounded rectangular blocks in predetermined orientations relative to said plate as said first bolt is moved relative to said first slot, said second bolt is moved relative to said second slot, and said third bolt is moved relative to said third slot.

* * * * *